US005156349A

United States Patent [19]

Wilson et al.

[11] Patent Number: 5,156,349

[45] Date of Patent: Oct. 20, 1992

[54] RETRATION SYSTEM

[76] Inventors: Donald L. Wilson, 4640 Mission Bell La., La Mesa, Calif. 92041; Michael O. Penton, 4974 Longford Pl., San Diego, Calif. 92117

[21] Appl. No.: 794,779

[22] Filed: Nov. 18, 1991

Related U.S. Application Data

[63] Continuation of Ser. No. 510,442, Apr. 18, 1990, abandoned.

[51] Int. Cl.[5] ..... B65H 75/36

[52] U.S. Cl. ..... 242/47.5

[58] Field of Search ..... 242/47.5, 55.01; 248/225.31, 228, 231.6, 638

[56] References Cited

U.S. PATENT DOCUMENTS

| | | | |
|---|---|---|---|
| 314,291 | 3/1885 | Harper . | |
| 1,384,153 | 7/1921 | Roos | 242/47.5 |
| 1,468,620 | 9/1923 | Addy | 242/47.5 X |
| 1,557,033 | 10/1925 | Davis | 242/47.5 |
| 1,864,891 | 6/1932 | Coberly et al. | 242/47.5 |
| 2,130,546 | 2/1938 | Hovey . | |
| 2,191,973 | 2/1940 | Sommer | 242/47.5 |
| 2,345,419 | 3/1944 | Olson . | |
| 2,503,018 | 4/1950 | Wittman | 242/47.5 |
| 2,730,183 | 1/1956 | Svoboda | 242/47.5 X |
| 3,380,786 | 4/1968 | Petersen . | |
| 3,427,719 | 2/1969 | Gordon et al. | 242/47.5 X |
| 3,429,516 | 2/1969 | Sharp et al. | 242/47.5 |
| 3,612,318 | 10/1971 | Ramsey | 242/47.5 X |
| 4,076,272 | 2/1978 | Penton . | |
| 4,174,816 | 11/1979 | Olson | 242/47.5 |
| 4,593,786 | 6/1986 | Tate . | |
| 4,691,806 | 9/1987 | Jansen et al. | 242/47.5 X |

FOREIGN PATENT DOCUMENTS

| | | | |
|---|---|---|---|
| 442556 | 2/1936 | United Kingdom | 242/47.5 |
| 2152476 | 8/1985 | United Kingdom | 242/47.5 |

*Primary Examiner*—Stanley N. Gilreath

*Attorney, Agent, or Firm*—Knobbe, Martens, Olson & Bear

[57] ABSTRACT

An improved vehicle hose retraction system is disclosed having a dual roller configuration which permits the hose to follow a smooth S-shaped path during extension and retraction, thereby maximizing the hose storage capacity of the system and avoiding kinds and abrasion to the hose. The axis of each roller is oriented so as to be generally perpendicular to the plane of the housing of the retraction system to minimize hose friction and wear. The housing is also provided with an angled hood which presents the free end of the hose in a position that facilitates connection. In addition, a locking mechanism is disclosed which prevents rotation of its members under vibrational conditions.

8 Claims, 3 Drawing Sheets

RETRATION SYSTEM

This application is a continuation of application Ser. No. 510,442, filed Apr. 18, 1990, now abandoned.

BACKGROUND OF THE INVENTION

The present invention relates to a system for automatically retracting and safely storing the supply hoses for large trucks of the tractor-trailer type and, more particularly, to a retraction system that can compactly accommodate excess hose length and present the hose ends at a position to facilitate connection to the trailer. The present invention also relates to an improved method of mounting the retraction device on the truck tractor.

In the trucking industry, large commercial trucks are typically comprised of a tractor and a trailer. The tractor, or driver's cab, contains the diesel engine and other control systems for operating the truck. The trailer, of course, is essentially a large storage container on wheels and is connected or disconnected to the tractor, as needed, for transit or storage purposes.

Although the trailer is dependent on the tractor for control, of necessity, the trailer does have its own mechanical systems for operation during transit. For example, the wheels of the trailer typically have a pneumatic brake system which requires a high-pressure air supply for operation. In addition, the trailer is equipped with running lights, braking lights, turn signals and the like, and therefore requires electrical power. Depending upon the type of trailer, it may also require additional electrical power for refrigeration or other mechanical systems, etc.

During transit, the trailer's mechanical systems must be controlled and supplied from the tractor. This mechanical supply is communicated from the tractor to the trailer by means of a plurality of conduits or hoses which extend from the back of the tractor to corresponding connections in the face of the trailer. Typically, there is a main pneumatic or air supply hose and an emergency air supply hose which extends between the tractor and trailer. There is also a separate electrical line connecting the two vehicles; however, the number and types of hose connections can vary with the type of tractor-trailer combination.

Such supply hoses are typically in the range of 10 to 15 feet long. When not in use, the truck operator usually attempts to store the hoses on the back of the tractor in some fashion. However, it has been found that the hoses become exposed to the elements, such as extreme heat or cold, or both, and also experience wear and damage in this exposed condition. Even when the truck is in use, any excess hose length is also subjected to weather, wear and damage. This is a critical problem since, should one or more of the hoses leak or fail, the braking or lighting system for the trailer might also fail, resulting in traffic accidents. In fact, it has been found that the majority of truck accidents is caused by partial or complete failure of the mechanical system of the trailer, usually as a result of supply hose problems.

Devices are shown in the prior art for automatically retracting the supply hoses for tractor-trailer type trucks for safe storage in a housing. One such device, which has been found to be very effective, is shown in U.S. Pat. No. 4,076,272, issued on Feb. 28, 1978 to Penton, a coinventor of the subject invention. Even with such devices, however, there is a need to make them more compact and light-weight and, therefore, more efficient. Weight is a very critical factor in the trucking industry since governmental agencies strictly regulate the amount of weight a truck can carry across public highways, and also because a truck operator is naturally interested in maximizing the load that can be carried in the trailer. Therefore, it is desirable to minimize the weight of additional items mounted on the truck, such as retraction devices. If the retraction system is made more compact, this requires that it accommodate additional lengths of supply hose without binding or kinking the hose. If the hose encounters friction or wear of this type in the retraction device, the same problem with wear and possible failure is experienced. Thus, the retraction device requires smooth operation in terms of extension and retraction, while at the same time being compact and light-weight.

In addition, various tractor configurations require the location of the retraction device to be mounted in a variety of positions. For example, the device may be mounted horizontally or vertically. Therefore, the angle between the hose exit of the retraction device with respect to the trailer face connection might be unusual or extreme and can produce wear on the hoses at the exit of the retraction system housing. Thus, there is also a need to present the hoses at an appropriate position to facilitate connection to the trailer.

Retraction systems of the prior art have also experienced some difficulty in being securely mounted on the truck tractors. Most tractors are equipped with a frame for purposes of mounting the trailer, which frame is comprised of two U-shaped channels. However, governmental regulations prohibit the bolting or welding of any devices directly to the frame. Therefore, there is a need for a secure mounting system for retraction devices.

SUMMARY OF THE INVENTION

The present invention meets the needs for improvements in previous retraction systems by providing a compact, yet light-weight, retraction device which can safely accommodate excess hose length within its housing. The present invention comprises a dual-roller system which utilizes the full housing length of the device in order to maximize hose storage capacity. One of the rollers is mounted on the retraction spring at the front portion of the housing; and the second roller is mounted on the rear wall of the device. Therefore, the retraction device housing can accommodate almost three full lengths of supply hose length.

The rollers are mounted with their axes perpendicular to the primary plane of the retraction device, whether it is mounted horizontally or vertically with respect to the tractor frame. This means that the hose movement within the housing is essentially in the same plane as, and parallel to, the plane of the housing itself. Therefore, the supply hose can travel in or out of the housing in a "serpentine-like fashion, without binding or abrading on the various surfaces of the housing.

The dual-roller system is also provided with offset mounting so that when the hose is payed out to its fullest extent, there is no contact between the rollers that could damage the hose. In addition, the roller offset configuration avoids any extremely tight turns which could kink or otherwise damage the hose. The rollers are mounted on a bracket which permits the rollers to move somewhat in the direction of their axis, within the confines of the top and bottom surfaces of the housing, in order to permit freedom of movement of the hoses; again, avoiding kinks and possible damage to the hose. The rollers are manufactured from a smooth yet durable material in order to avoid friction on the hoses.

The retraction device of the present invention is also provided with a hood which presents the end of the hose in a position to facilitate connection to the face of the trailer. The hood is comprised of a roller bar and an angled exit surface which combine to form a gentle turn in the angle of the hose in order to position the hose, in most tractor-trailer configurations, for direct connection with the trailer. This gentle turning avoids any sharp angles or kinks or resulting damage that could be caused to the hose in terms of the connection between the tractor and the trailer.

Significantly, the present invention is also provided with an improved mounting system which utilizes a locking plate and bottom plate combination to prevent rotation in the mounting mechanism. This mounting system complies with government regulations while, at the same time, providing secure bolting to the tractor frame.

In summary, the retractor device of the present invention provides less hose exposure and safer performance. It protects supply hoses from weathering, condensation, freezing, cracking, pinching and overall wear and tear. By protecting the supply hoses of the tractor-trailer rig, the present retraction device reduces the chance of accidents caused by brake or electrical failure. It is also constructed from durable but lightweight materials to maximize protection and minimize weight. Under normal operations, it encloses approximately 80% of the hose length in order to accomplish its protection purposes. It also facilitates accurate connections, making it much less likely to cross the service and emergency pneumatic lines when hooking up the trailer to the tractor.

DETAILED DESCRIPTION OF THE INVENTION

Figure 1:
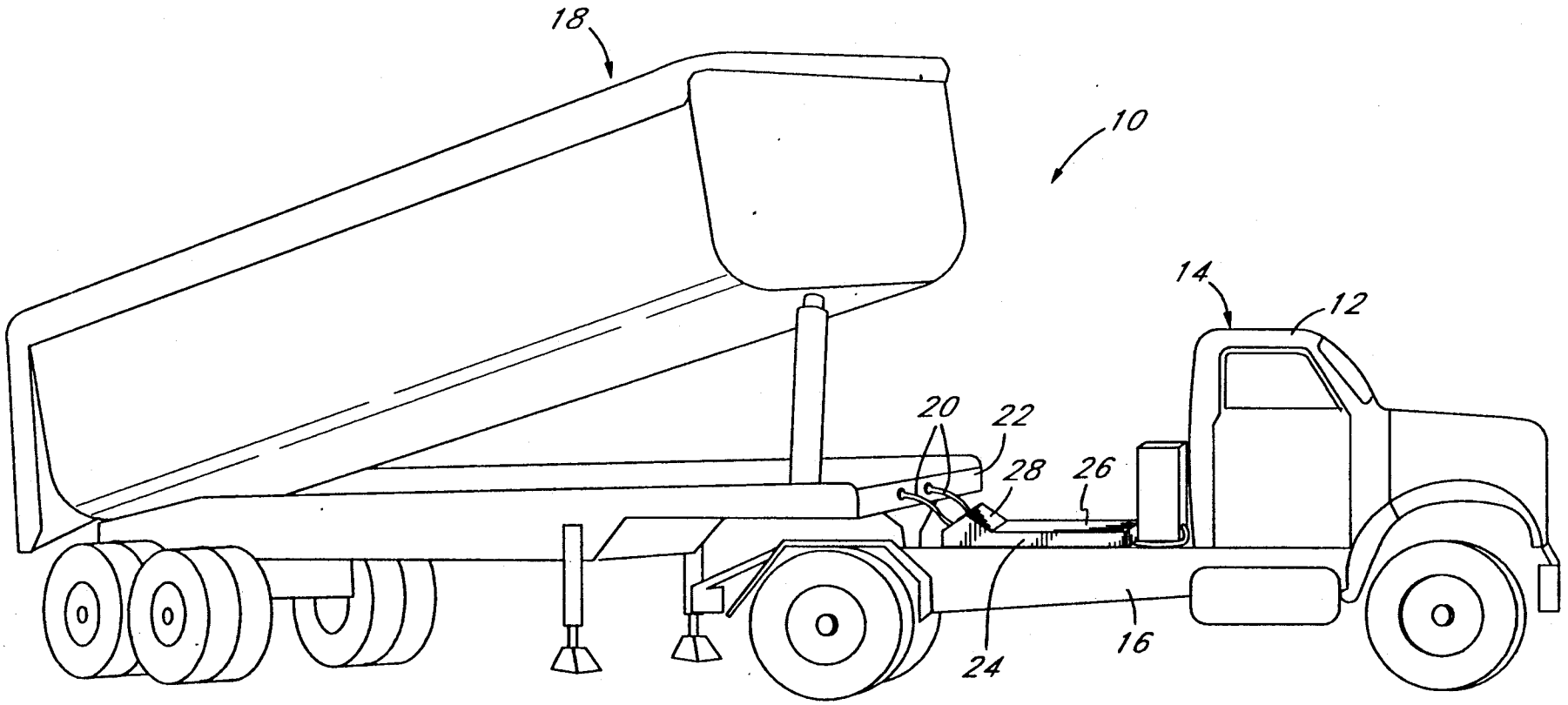
FIG. 1 is a perspective view of a tractor-trailer rig illustrating one possible location on the tractor for the retraction device of the present invention.

Referring to FIG. 1, there is shown a large commercial truck 10 of the tractor-trailer type. In this particular case. a dump truck is shown; however, the principles of the present invention apply equally to a wide variety of commercial trucks as well as other large vehicles requiring supply hose connections. As shown in FIG. 1, the driver's cab 12 of the tractor 14 is supplied with a frame 16 extending from the rear thereof for purposes of attaching the trailer 18. Supply hoses 20 also extend from the rear of the tractor 14 in order to connect with appropriate couplings at the face 22 of the trailer 18.

The retraction device 24 of the present invention is shown in FIG. 1 mounted on the upper surface of the frame 16 of the tractor 14. The retraction device 24 is comprised, generally, of an essentially rectangular planar housing 26 and a hood 28 mounted on the housing 26 and situated at the rear thereof. The supply hoses 20 extend from the rear of the housing of the retraction device 24 and connect with the trailer 18 in order to supply air and electrical power to the trailer.

As shown in FIG. 1, only that portion of the hose 20 which is necessary to make the trailer connection extends from the retraction device 24. There is no slack or excess hose unnecessarily exposed when the present retraction device is utilized. As explained in more detail below, any excess hose is automatically retracted into the housing 26 of the device when the trailer 18 is hooked up to the tractor 14. When the trailer is not connected to the tractor, the supply hoses are retracted completely into the housing for efficient storage and protection.

The present retraction device 24, as shown in FIG. 1, is mounted on the tractor frame 16 so that the plane of the housing 26 is in a generally horizontal position, which is the typical installation. However, depending upon the particular tractor-trailer configuration, the present retraction device may be mounted so that the plane of the housing is generally vertical, and so that the hood 28 is either at the upper or lower end of the housing 26; or the device 24 may be mounted in other configurations as needed. It is important to note that the principles of the present invention apply equally to other mounting configurations, as well as that shown in FIG. 1; however, for convenience and ease of description herein, the relative surfaces and directions will be described with the device in the horizontal position shown in FIG. 1.

Figures 2, 3:
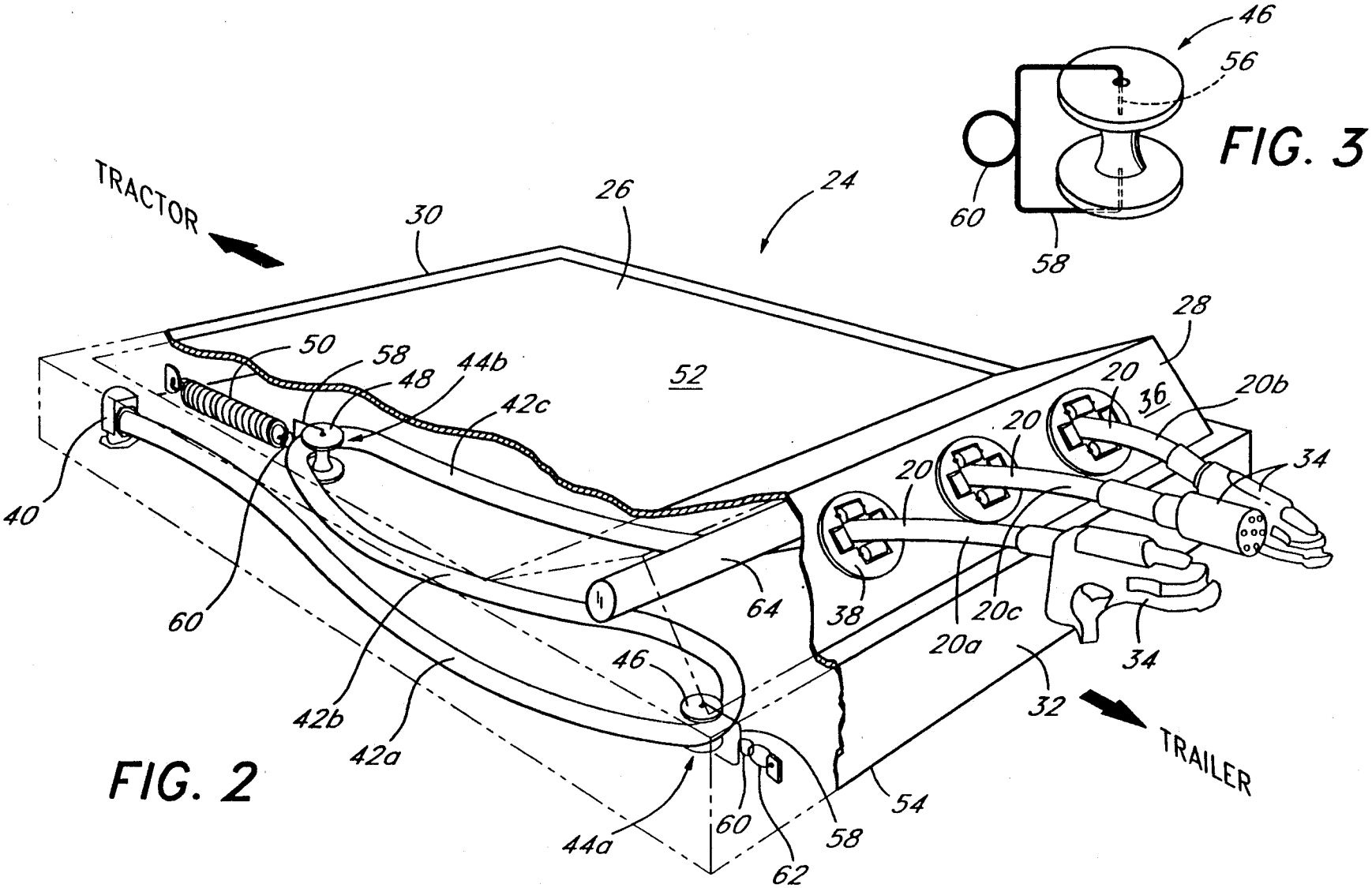
FIG. 2 is a close-up perspective view of the retraction device of the present invention illustrating the top of the housing, partially broken away to reveal the dual-roller system of the present retraction device.
FIG. 3 is a close-up perspective view of a single roller and its associated mounting bracket.

Referring to FIG. 2, the retraction device 24 is illustrated with the front end 30 of the housing 26 directed toward the tractor 14 and the rear end 32 of the housing 26, including the hood 28 mounted thereon, directed toward the trailer 18. Several supply hoses 20 with individual coupling connectors 34 on the free end thereof are shown extending from the exit surface 36 of the hood 28 at the rear 32 of the retraction device 24. Typically, there are two air supply hoses 20: one for actual service operation **20*a* and one for emergency purposes 20*b*. Both air supply hoses have the- same connectors 34 on their free ends; thus, an important advantage of the present invention is the simplicity of making these respective air hose connections with a very low likelihood of crossing the two identical air supply hoses, as sometimes happens when no retraction device is being used. Also shown is a single electrical supply hose 20*c* with its respective coupling connector 34**.

Each supply hose 20 is protected as it leaves the retraction device 24 by means of a roller system 38 mounted on the exit plate 36 of the hood 28, which roller system 38 is described in more detail and shown in U.S. Pat. No. 4,076,272. When tractor manufacturers mount supply hoses 20 on the tractors, or when the hoses 20 are retrofitted to tractors, they are usually supplied with a very long hose, usually in the range of 10 to 15 feet, so as to ensure adequate length to make a connection between the tractor and a trailer under virtually all tractor-trailer configurations. Thus, typically, the distance separating the two vehicles is not at the extreme and excess hose must be protected from wear or damage. Therefore, it is an important feature of the present invention that the retraction device 24 be able to accommodate excess hose while still permitting smooth and efficient operation for hose extension and retraction.

This feature of the present invention is shown in connection with FIG. 2, which is partially broken away to reveal the inner workings of the present retraction device in connection with a single hose 20*a*, hereinafter referred to as hose 20, for convenience. However, it should be noted that the retraction mechanism for the other hoses 20*b* and 20*c* mounted in the retraction device 24 function the same as the single hose 20*a* shown in FIG. 2 and described below.

Thus, FIG. 2 illustrates the fixed end 40 of the hose 20 entering the housing 26 of the retraction device near the front end 30 which is adjacent to the tractor. The hose 20, in its retracted position shown in FIG. 2, is comprised of a three lengths 42*a*, 42*b* and 42*c*, including two U-shaped turns 44*a* and 44*b*, which are accommodated within the housing 26 of the device, with only a small portion of the free end of the hose extending from the exit plate 36 of the hood 28 and having the coupling connector 34 mounted thereon. The first and second lengths 42*a* and 42*b* of hose 20 are divided by the first turn 44*a* which passes around a first roller 46 mounted on the rear wall 32 of the housing 26, as shown in FIG. 2. The second and third lengths 42*b* and 42*c* of the hose 20 are divided by a second roller 48 which is mounted at the distal end of the retraction spring 50, the proximal end of which is mounted to the front wall 30 of the housing 26. Thus, as can be seen in FIG. 2, the full length of the retraction device 24 is utilized to store the supply hose 20, thus maximizing storage capability while minimizing the size and weight of the device.

As the hose 20 is drawn out of the device 24 in order to make a connection with the trailer, it flows smoothly around the dual-roller system without kinking or binding, thus protecting the hose. Furthermore, the retraction spring 50 biases the hose toward the device, so that any excess hose, after making the trailer connection, is drawn back into the housing 26.

The configuration of the dual-roller system also advantageously enhances the operation of the device. For example, as shown in FIG. 2, it can be seen that the first and second rollers 46, 48 are offset longitudinally with respect to one another, thus permitting a smooth "S" pattern for the hose 20 as it winds around the two rollers. This configuration avoids sharp turns and kinks in the hose. Furthermore, as the hose 20 is extended, it should be noted that the second roller 48 will tend to approach the first roller 46 as the retraction spring 50 is extended. If the hose were to be fully extended, the offset nature of the dual-roller configuration would avoid any contact between the two rollers and any resulting damage or pinching to the hose.

Another important advantage of the dual-roller system is that the axis of each roller 46, 48 is oriented so as to be perpendicular to the horizontal plane of the housing 26. This vertical orientation causes the hose 20 to travel, as it is extended and retracted, in a generally horizontal plane, within the confines of the upper and bottom surfaces 52, 54 of the housing 26. Therefore, contact or friction between the hose and the surfaces of the housing is avoided. In essence the hose travels in a "serpentine-like" fashion around the rollers 46, 48 in a horizontal plane, and movement in a vertical plane, such as might cause abrasion with the surfaces of the housing, is minimized or eliminated.

The construction of the rollers 46, 48 is shown in more detail in FIG. 3. The rollers are constructed from a durable polymer material, one such material preferably being Delrin TM (a trademark of DuPont). This material is soft and naturally lubricating but also durable and strong. The axis 56 for each roller 46, 48 is provided by a U-shaped bracket 58 having a ring 60 at the distal end thereof. This ring 60 can be mounted onto the distal end of the retraction spring 50 or to a similar ring 62 on the rear wall 32 of the housing 26, as shown in FIG. 2, so that free movement of the roller 46, 48 is provided. In addition, some movement in the vertical plane is permitted so that undue stresses and friction are not exerted on the hose.

Another advantage of the present system is the angled configuration of the hood 28, as shown in FIG. 2, which positions the free end of the hoses 20 in a generally upwardly-facing direction for ease of connection with the trailer. That is, as illustrated in FIG. 1, the position of the retraction device 24 with respect to the location on the face 22 of the trailer 18 where the hose connection is made, is usually at different vertical heights from the ground. If the vertical difference between the retraction device and the couplings on the trailer face is extreme, and if, for example, the tractor and trailer were configured so as to be fairly close together, the supply hose might have to turn at a very sharp angle in an upward direction in order to make the connection. This angle would increase the stresses and friction on the hose, thus accelerating its wear and possible damage.

Accordingly, the present invention is configured so that the hood 28, and particularly the exit plate 36 thereof, provides a gentle turn in the hose 20 in an upward direction in order to facilitate the connection with the trailer. This gentle turn is facilitated by means of a roller bar 64 located within the hood 28, as shown in FIG. 2, under which the hose 20 passes before exiting the roller system 38 in the exit plate 36. This gentle turn configuration in the present retraction device is also an advantage when the device is mounted in other configurations so as to avoid sharp turns and unnecessary wear on the supply hoses. It should also be noted that the advantages of the hood can be achieved by utilizing hoods of widely varying configurations, other than that shown in FIG. 2. That is, this gentle turn in the hose can be achieved with devices shaped differently than the triangular shape of the present hood.

Figure 4:
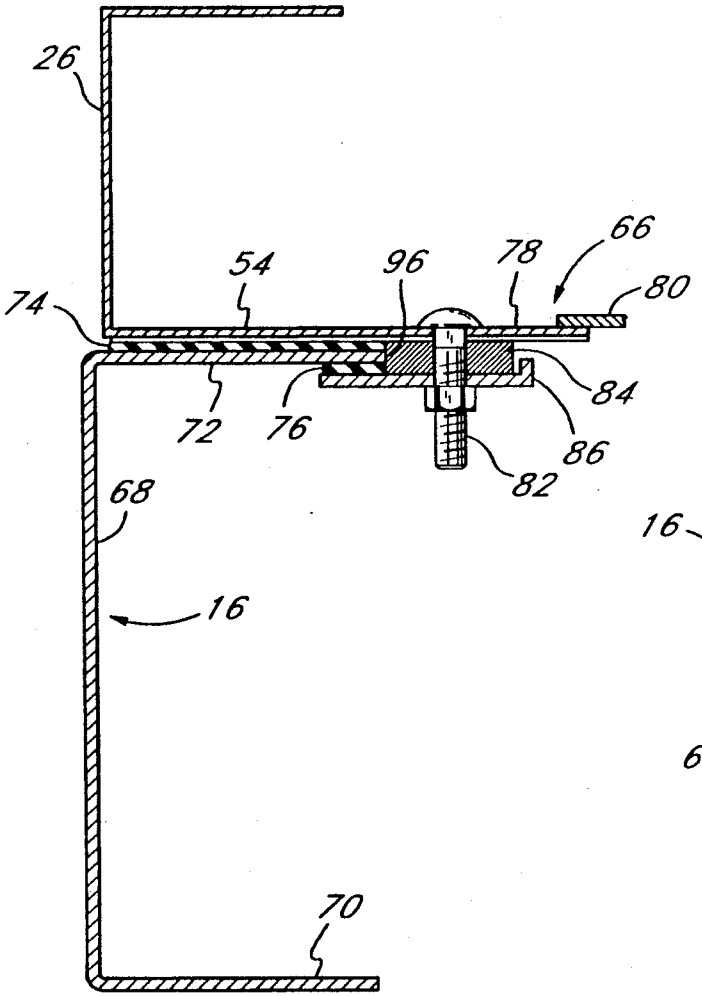
FIG. 4 is a partial cross-sectional view taken through the frame of the tractor, illustrating the mounting mechanism of the present invention.

The mounting system 66 of the present invention is illustrated in FIG. 4, which shows a cross section through the frame 16 of the tractor 14 illustrating one of the channels 68 which comprises the frame 16. The frame 16 is also comprised of a similar channel (not shown) which would face the channel 68 shown in FIG. 4. The channel 68 shown in FIG. 4 is generally U-shaped and rotated clockwise 90° in order to form a lower horizontal flange 70 and an upper horizontal flange 72. The connection 66 shown in FIG. 4 is one of four connections which mount the housing 26 of the retraction device 24 to the tractor frame 16, each connection being generally near the four corners of the housing. In other words, the housing rests upon the upper flange 72 of the two channels 68 which form the tractor frame 16, and spans across said channels 68 with two connections 66 of the type shown in FIG. 4 on each channel.

As pointed out above, government regulations prohibit any direct welding or bolting of devices or accessories to the frame 16 of the tractor 14. Accordingly, the housing 26 actually rests upon a rubber gasket 74, preferably about ⅜" in thickness, which is situated between the bottom surface 54 of the housing 26 and the upper flange 72 of the channel 68. A similar gasket 76 is also provided between the mounting mechanism 66 and the lower surface of the upper flange 72, as shown in FIG. 4. This configuration electrically insulates the retraction device from the tractor frame.

FIG. 4 also illustrates the two-part construction of the bottom surface 54 of the housing 26. The rectangular frame 78 of the housing 26 is preferably constructed from 16-gauge steel for strength, while the bottom plate 80 of the housing is constructed from 22-gauge steel and is welded to the housing frame 78 as shown.

Figure 5:
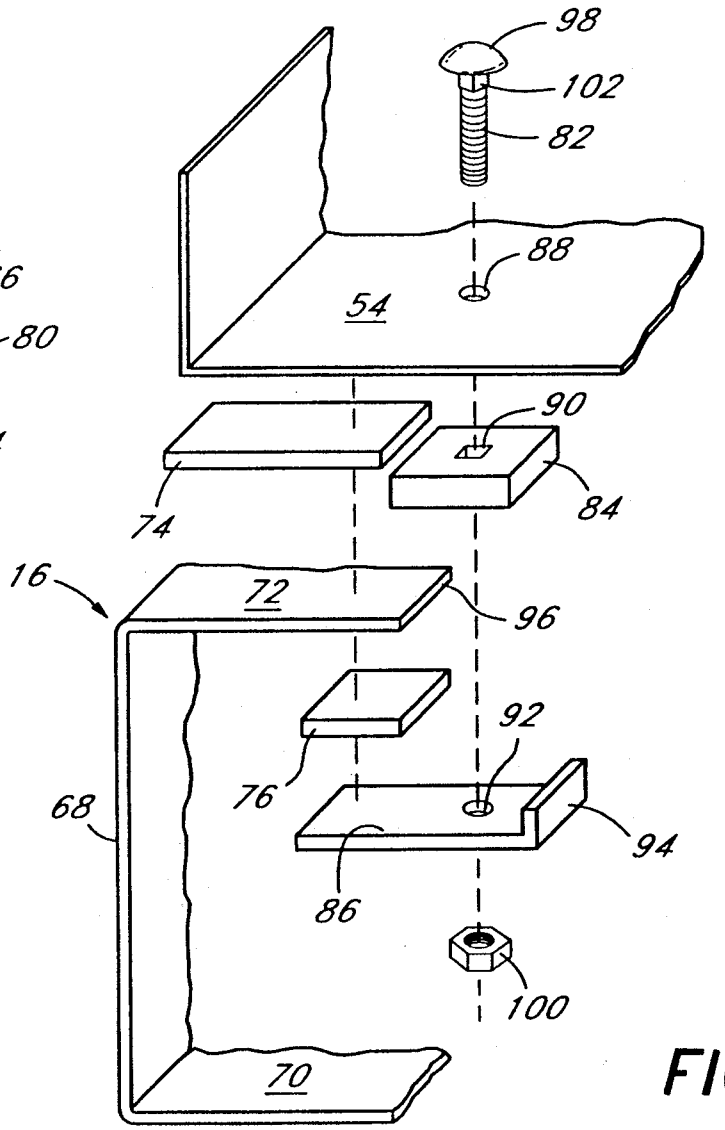
FIG. 5 is an exploded view of FIG. 4, illustrating the individual elements of the mounting mechanism for the present invention.

The mounting mechanism 66 for attaching the housing 26 to the upper flange 72 of the channel 16 of the frame 16 is illustrated in FIG. 4, and the exploded view in FIG. 5. The mounting mechanism is comprised of a carriage bolt 82, a lock plate 84 and a bottom plate 86. The carriage bolt 82 extends downward through a hole 88 in the bottom surface 54 of the housing 26 and corresponding holes 90, 92 in the lock plate 84 and bottom plate 84. As easily seen in FIG. 5, the lock plate 94 is essentially square and has a square opening 90. The bottom plate 86 is provided with an upturned end 94 along one edge.

In the assembled condition shown in FIG. 4, the lock plate 84 is positioned below the bottom surface 54 of the housing 26 and abuts the distal edge 96 of the upper flange 72 of the channel 68. The bottom plate 84 is situated immediately below the lock plate 84 such that the upturned end 94 abuts one edge of the square lock plate 84. The holes are aligned so that the carriage bolt 82 can pass completely through all three elements, with the rounded head 98 of the carriage bolt 92 being located inside the housing 26 in order to avoid any abrasion or damage to the supply hoses. A lock nut 100 and washer (not shown) is then applied to the end of the carriage bolt 92, and the entire mechanism is adequately tightened.

In this configuration, any vibration in the tractor-trailer combination will not result in rotation of the mounting mechanism 66 due to the locking interrelationship between the lock plate 84 and the bottom plate 86. That is, the lock plate 84 will be prevented from rotating, both by virtue of the carriage bolt shank 102 as it mates in the square hole 90 of the lock plate 84, and also the abutment of the upturned end 94 of the bottom plate 86 against the lock plate 84. The lock plate 84 is also prevented from rotating by its abutment against the distal edge 96 of the upper flange 72. Therefore, a secure attachment is provided.

In conclusion, the improved retraction device of the present invention provides a compact, efficient yet light-weight mechanism for protecting the supply hoses of a tractor-trailer combination.

What is claimed:

1. A hose retraction system comprising:

a housing for the storage and protection of a plurality of hoses, said housing having front and rear ends, said housing having minimized dimensions in order to minimize its weight, whereby said hoses are compactly stored therein, each of said hoses comprising a first loop, a second loop, and a distal end terminating at a connector positioned outside of said housing at an end of said housing opposite from said second loop;

a plurality of first storage rollers mounted within said housing in a fixed relationship thereto, each of said first storage rollers receiving a first portion of one of said plurality of hoses so as to define said first loop of said hoses when said hoses are retracted within said housing;

a plurality of second storage rollers mounted to said housing by way of a retraction spring, said second storage rollers providing a means for selectively allowing said distal end of said hoses to be drawn out of said housing while taking up any slack in said hoses so as to compactly store said hoses within said housing, each of said second storage rollers receiving a second portion of one of said plurality of hoses so as to define said second loop of said hoses when said hoses are retracted within said housing;

a first change of direction roller extending substantially across said housing, said first change of direction roller being positioned substantially parallel with said front and rear ends of said housing and being slidably engageable with a third portion of each of said plurality of hoses when said hoses are retracted within said housing; and a plurality of second change of direction rollers, each of said second change of direction rollers being engageable with a fourth portion of one of said plurality of hoses proximate to said distal end of said hoses when said hoses are retracted within said housing.

2. The hose retraction system of claim 1, wherein said first change of direction roller causes a segment of said hose, extending between said first and second change of direction rollers, to be positioned at a first gentle angle, relative to said second loop of said hose.

3. The hose retraction system of claim 2, wherein said housing has an exit and wherein said second change of direction rollers cause a second segment of said hose, extending between said connector and said second change of direction roller, to be positioned at a second gentle angle relative to said first gentle angle when said distal end of said hoses are drawn away from said housing.

4. The hose retraction system of claim 1, wherein said first and second change of direction rollers are mounted within a hood in communication with said housing such that said hoses pass through said hood from said housing prior to exiting said housing.

5. The hose retraction system of claim 4 wherein said housing has a generally planar configuration and said hoses exit said hood at an angle with respect to said plane of said housing.

6. The hose retraction system of claim 4, wherein said hood defines an exit plane being positioned at an angle with respect to the plane of said housing, said second change of direction rollers being located in said exit plane.

7. A hose retraction system, comprising:

a housing for the storage and protection of a plurality of hoses, each of said hoses having a first loop, a second loop and a distal end terminating at a connector;

a plurality of first and second storage rollers mounted within said housing for receiving said first and second loops of said hoses, said plurality of first and second storage rollers selectively allowing said hoses to be drawn out of said housing while taking up any slack in said hoses so that said hoses are compactly stored within said housing;

a first change of direction roller engaging a segment of each hose, said first change of direction roller allowing said segment of said hoses to change direction at an angle with respect to said second loop; and a plurality of second change of direction rollers for allowing said distal end of said hoses to change direction at a second angle with respect to said first angle, whereby frictional forces on said hoses proximate to said distal end of said hoses are distributed over both of said first change of direction roller and said plurality of said second change of direction rollers in order to minimize friction and wear on said hoses, thereby prolonging the life of said hose.

8. The hose retraction system of claim 7, further comprising a mounting system for attaching a bottom surface of said housing to a trailer frame having a flange, said mounting system comprising:

a locking plate positioned below said flange and having at least one flat edge, said locking plate having a non-round opening extending therethrough;

a bottom plate positioned above said locking plate and having an upright edge which abuts said one flat edge of said locking plate, thereby preventing rotation of said mounting system under conditions of vibration;

a bolt extending through said bottom surface of said housing and having a corresponding non-round shank received by said non-round hole extending through said locking plate to clamp said housing to said flange of said trailer frame; and at least one gasket positioned between said plates for minimizing vibration.

* * * * *